US009528382B2

(12) United States Patent
Morgan et al.

(10) Patent No.: US 9,528,382 B2
(45) Date of Patent: Dec. 27, 2016

(54) AIRFOIL HEAT SHIELD

(75) Inventors: Victor John Morgan, Greenville, SC (US); David Richard Johns, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1609 days.

(21) Appl. No.: 12/615,674

(22) Filed: Nov. 10, 2009

(65) Prior Publication Data

US 2011/0110771 A1 May 12, 2011

(51) Int. Cl.

*F01D 25/12* (2006.01)
*F01D 5/28* (2006.01)
*F01D 5/14* (2006.01)

(52) U.S. Cl.

CPC ..... *F01D 5/288* (2013.01); *F01D 5/147* (2013.01); *F05D 2230/80* (2013.01); *F05D 2230/90* (2013.01); *F05D 2260/202* (2013.01); *F05D 2260/36* (2013.01)

(58) Field of Classification Search

CPC ..... F01D 5/147; F01D 5/288
USPC ..... 415/177–180; 416/62, 96 R, 97 R, 209, 416/224

See application file for complete search history.

(56) References Cited

U.S. PATENT DOCUMENTS 3,528,751 A 9/1970 Quinones et al.
4,519,745 A * 5/1985 Rosman et al. ..... 416/96 A
4,786,234 A * 11/1988 Readnour ..... 416/97 R
4,793,770 A * 12/1988 Schonewald et al. ..... 415/190
5,090,866 A * 2/1992 Blair ..... 415/115
5,320,483 A 6/1994 Cunha et al.
5,332,357 A 7/1994 Tubbs
5,348,446 A * 9/1994 Lee et al. ..... 416/241 R
5,464,322 A 11/1995 Cunha et al.
5,484,258 A 1/1996 Isburgh et al.
5,488,825 A 2/1996 Davis et al.
5,669,759 A 9/1997 Beabout
5,827,045 A * 10/1998 Beeck ..... 416/96 A
5,993,155 A 11/1999 Endres et al.
5,993,156 A 11/1999 Bailly et al.
6,036,436 A 3/2000 Fukuno et al.
6,146,091 A 11/2000 Watanabe et al.
6,174,133 B1 1/2001 Bunker
6,241,467 B1 6/2001 Zelesky et al.
6,254,334 B1 7/2001 LaFleur
6,261,054 B1 7/2001 Bunker et al.
6,264,428 B1 7/2001 Dailey et al.
6,379,118 B2 4/2002 Lutum et al.
6,454,526 B1 9/2002 Cunha et al.
6,514,046 B1 * 2/2003 Morrison et al. ..... 416/229 A
6,582,194 B1 * 6/2003 Birkner et al. ..... 416/97 R
6,742,991 B2 6/2004 Soechting et al.
6,808,367 B1 10/2004 Liang
6,884,036 B2 4/2005 Shi et al.
6,955,523 B2 10/2005 McClelland
6,955,525 B2 10/2005 Liang
6,981,846 B2 1/2006 Liang
7,080,971 B2 7/2006 Wilson et al.
(Continued)

*Primary Examiner* — Woody A Lee, Jr.
(74) *Attorney, Agent, or Firm* — Ernest G. Cusick; Frank A. Landgraff

(57) ABSTRACT

Exemplary embodiments include a multi-layer, modular and replaceable heat shield for gas turbines. The heat shield apparatus can include a base layer adjacent the airfoil and a thermal layer coupled to the base layer, wherein the base layer and the thermal layer match a contour of the airfoil.

17 Claims, 7 Drawing Sheets

(56) References Cited

U.S. PATENT DOCUMENTS

| | | | | |
|---|---|---|---|---|
| 7,090,461 | B2 | 8/2006 | Liang | |
| 7,118,326 | B2 | 10/2006 | Liang | |
| 7,198,458 | B2 | 4/2007 | Thompson | |
| 7,255,534 | B2 | 8/2007 | Liang | |
| 7,281,895 | B2 | 10/2007 | Liang | |
| 7,837,438 | B2 * | 11/2010 | Campbell | 415/191 |
| 2010/0074726 | A1 * | 3/2010 | Merrill et al. | 415/115 |

* cited by examiner

AIRFOIL HEAT SHIELD

BACKGROUND OF THE INVENTION

The subject matter disclosed herein relates to turbine airfoils, and more particularly to airfoil heat shields.

Airfoils (i.e., vanes and blades) are typically disposed in hot gas paths of gas turbines. A blade, which can also be referred to as a "bucket" or "rotor", can include an airfoil mounted to a wheel, disk or rotor, for rotation about a shaft. A vane, which can be referred to as a "nozzle" or "stator", can include an airfoil mounted in a casing surrounding or covering the shaft about which the blade rotates. Typically, a series of blades are mounted about the wheel at a particular location along the shaft. A series of vanes can be mounted upstream (relative to a general flow direction) of the series of blades, such as for improving efficiency of a gas flow. Vanes succeeded by blades are referred to as a stage of the gas turbine. Stages in a compressor compress gas, for example, to be mixed and ignited with fuel, to be delivered to an inlet of the gas turbine. The gas turbine can include stages in order to extract work from the ignited gas and fuel. The addition of the fuel to the compressed gas may involve a contribution of energy to the combustive reaction. The product of this combustive reaction then flows through the gas turbine. In order to withstand high temperatures produced by combustion, the airfoils in the turbine need to be cooled. Insufficient cooling results in undue stress on the airfoil and over time this stress leads or contributes to fatigue and failure of the airfoil. To prevent failure of turbine blades in gas turbine engines resulting from operating temperatures, film cooling has been incorporated into blade designs. In film cooling, cool air is bled from the compressor stage, ducted to the internal chambers of the turbine blades, and discharged through small holes in the blade walls. This air provides a thin, cool, insulating blanket along the external surface of the turbine blade. Film cooling can be inefficient because it can create non-uniform cooling, since close to the holes the film temperature is much cooler that farther away from the holes. Accordingly, a need exists for improved cooling of the airfoil.

BRIEF DESCRIPTION OF THE INVENTION

According to one aspect of the invention, a heat shield apparatus for an airfoil is described. The heat shield apparatus can include a base layer adjacent the airfoil and a thermal layer coupled to the base layer, wherein the base layer and the thermal layer match a contour of the airfoil.

According to another aspect of the invention, an airfoil system is described. The airfoil system can include an airfoil having a leading edge, impingement holes, a trailing edge passage, a pressure side and a suction side and a heat shield disposed over the airfoil.

According to yet another aspect of the invention, a gas turbine is disclosed. The gas turbine can include a compressor section, a combustion section operatively coupled to the compressor section, a turbine section operatively coupled to the combustion section, an airfoil disposed in the turbine section and a multi-layer heat shield disposed on the airfoil.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
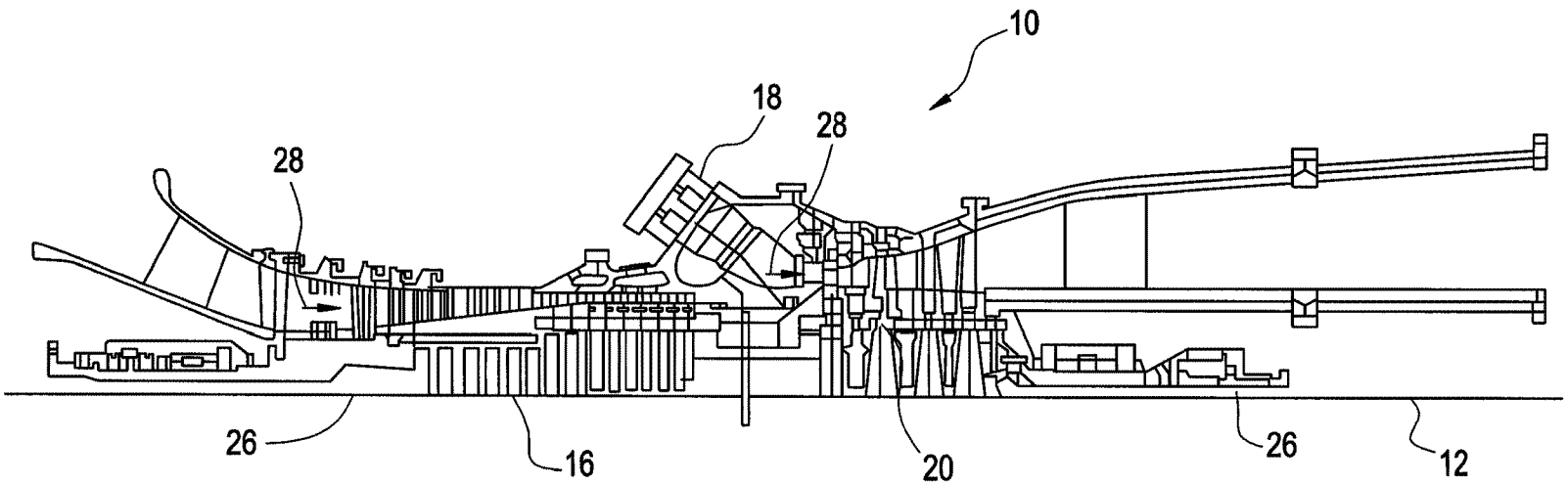
FIG. 1 illustrates a gas turbine system in which exemplary air foil heat shields may be implemented.

FIG. 1 illustrates a gas turbine system 10 in which exemplary airfoil heat shields may be implemented. The exemplary airfoil heat shields described herein have been described with respect to a gas turbine. In other exemplary embodiments, the airfoil heat shields described herein can be implemented with other systems in which heat shield protection is desirable such as, but not limited to, steam turbines and compressors. The gas turbine system 10 is illustrated circumferentially disposed about an engine centerline 12. The gas turbine system 10 can include, in serial flow relationship, a compressor 16, a combustion section 18 and a turbine 20. The combustion section 18 and the turbine 20 are often referred to as the hot section of turbine engine 10. A rotor shaft 26 operatively couples the turbine 20 to the compressor 16. Fuel is burned in combustion section 18 producing a hot gas flow 28, for example, which can be in the range between about 3000 to about 3500 degrees Fahrenheit. The hot gas flow 28 is directed through the turbine 20 to power gas turbine system 10.

Figure 2:
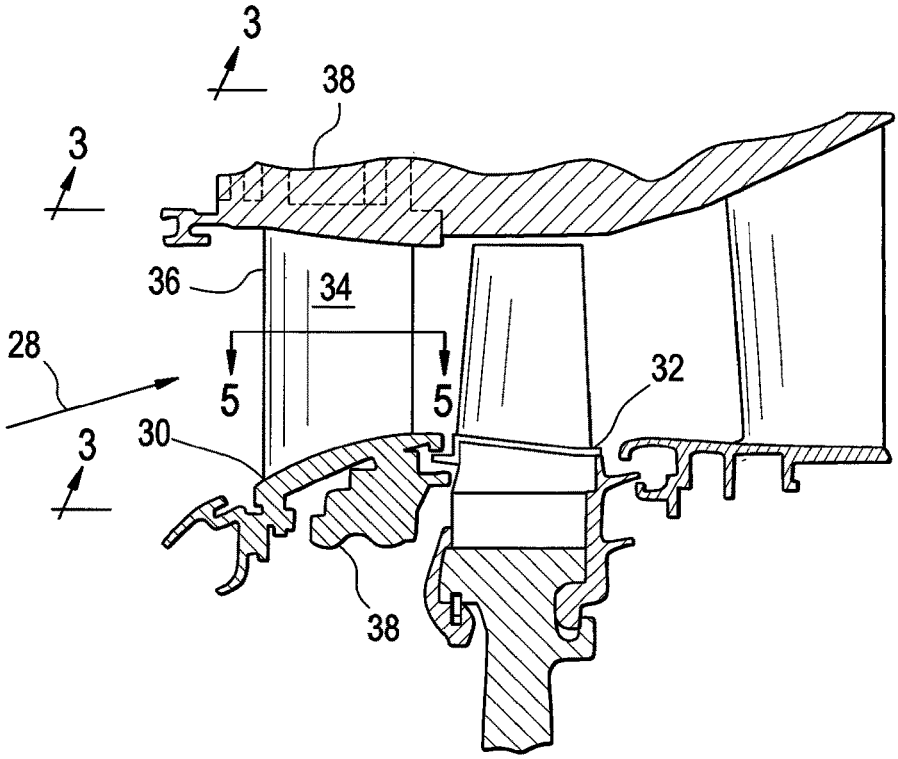
FIG. 2 illustrates the turbine as illustrated in FIG. 1.

FIG. 2 illustrates the turbine 20 of FIG. 1. The turbine 20 can include a turbine vane 30 and a turbine blade 32. An airfoil 34 can be implemented for the vane 30, which the airfoil 34 can be disposed in a portion of the compressor 16, a portion of the combustion section 18, or a portion of the turbine. The vane 30 has an outer wall 36 (or leading edge) that is exposed to the hot gas flow 28. The turbine vanes 30 may be cooled by air routed from one or more stages of compressor 16 through a casing 38 of machine 10. Furthermore, the outer wall 36 of the airfoil 34 can be fitted with an exemplary disposable heat shield as now described.

Figure 3:
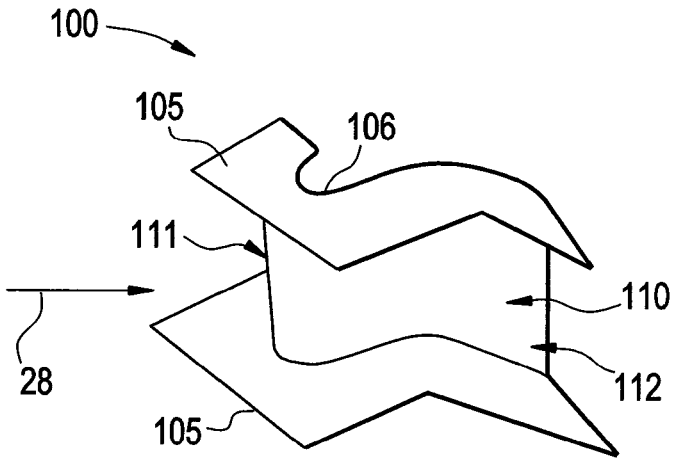
FIG. 3 illustrates a side perspective view of an exemplary heat shield.

FIG. 3 illustrates a side perspective view of an exemplary heat shield 100. In exemplary embodiments, the heat shield 100 can be a single integral piece that is configured to affix to the airfoil 34 as described above. As further discussed herein, the heat shield, although a single integral piece, can be a multi-layer design. The heat shield 100 can also be affixed to other portions of the gas turbine system 10 that need heat protection. In exemplary embodiments, the heat shield 100 is configured to be affixed and removed with minimal downtime to the gas turbine system 10 because the heat shield is a modular part of the airfoil 34, and can be removed as described herein. In exemplary embodiments, the heat shield 100 can be frictionally affixed to the airfoil. As such, the heat shield 100 includes several frictional pieces. In exemplary embodiments, the heat shield 100 includes casing walls 105 (i.e., upper and lower) configured to mechanically engage the casing 38 of the gas turbine system 10. The casing 38 can include a variety of shapes and curvatures. As such, the casing walls 105 can include corresponding shapes and curvatures depending on the shape of the casing 38. The heat shield 100 can further include a wall 110 disposed between the casing walls 105. The wall 110 can be oriented perpendicular to the casing walls 105. Furthermore, the casing walls 105 include a cutout 106 having a curvature that matches a curvature of the airfoil 34. The cutout 106 further matches a curvature of the wall 110. In exemplary embodiments, the wall 110 further includes a leading edge 111 and a trailing edge 112. The leading edge 111 is an outer convex portion of the wall 110 that initially receives the hot gas flow 28 at various angles of attack. Those skilled in the art appreciate that the leading edge 111 covers a leading edge of the airfoil 34.

Figure 4:
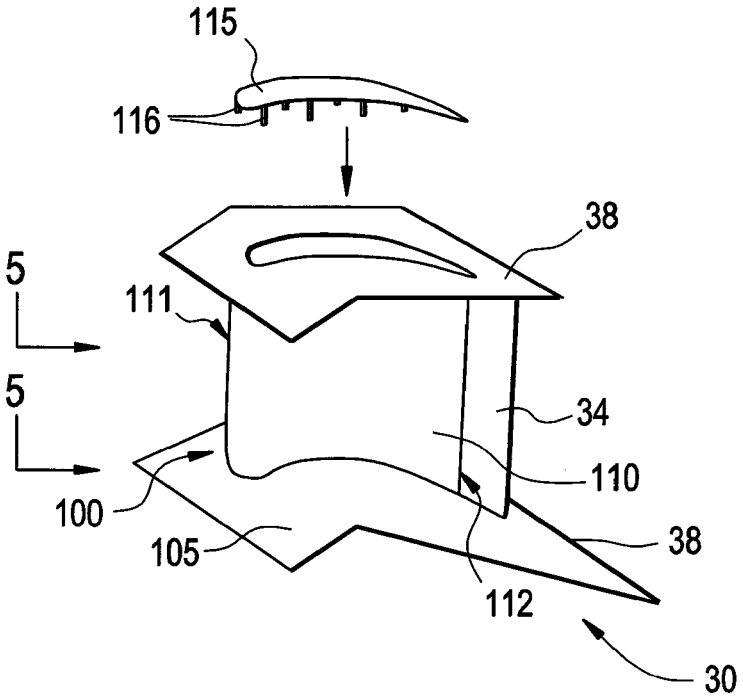
FIG. 4 illustrates the airfoil of FIG. 2 including an exemplary heat shield.

FIG. 4 illustrates the airfoil 34 of FIG. 2 including an exemplary heat shield 100. As described herein, the heat shield 100 is mechanically affixed to the airfoil 34 via frictional forces between the casing 38 and casing walls 105, and between the airfoil 34 and wall 110. In other exemplary embodiments, mechanical fasteners such as, but not limited to, bolts can be implemented to affix the heat shield 100 to the airfoil 34. In exemplary embodiments, a top plug 115 can further be affixed to a portion of the casing 38. The top plug 115 can include a series of prongs 116 disposed adjacent the airfoil 34. The heat shield 100 can be affixed over the prongs 116 when affixed to the airfoil 34, thereby increasing the frictional forces between the heat shield 100 and the airfoil 34. In exemplary embodiments, several other frictional surfaces and devices can be included on the airfoil 34 and the heat shield to assist affixation and removal of the heat shield 100. For example, a series of mating dovetails can be disposed on the airfoil 34 and heat shield 100.

As discussed herein, the heat shield 100 can be in-field replicable at combustion intervals. The slip-on heat shield 100 covers the leading edge of the inner side wall and outer side wall of the airfoil 34 as well as the majority of the pressure side and to the high camber point on the suction side. The heat shield 100 can be held on with a combination of pressure side trailing edge prongs 116 that interface with recesses on the nozzles and pins on the suction side high camber point. Although any type of positive detainment devices can be implemented, the series of curved dovetails can cover the inner side wall and/or outer side wall of the airfoil 34. The airfoil 34 can then match up with a mating series of dovetails on the heat shield 100. The dovetails can be curved in the direction of the nozzle to allow for the sliding-on nature of the replaceable heat shield 100. Furthermore, bolts can be placed above a transition piece seal (that interfaces with the combustor 18) on the leading edge of the airfoil 34. Therefore, the heat shield 100 can be replaceable at just the combustion intervals when the transition piece of the combustor 18 and liners are removed.

Figure 5:
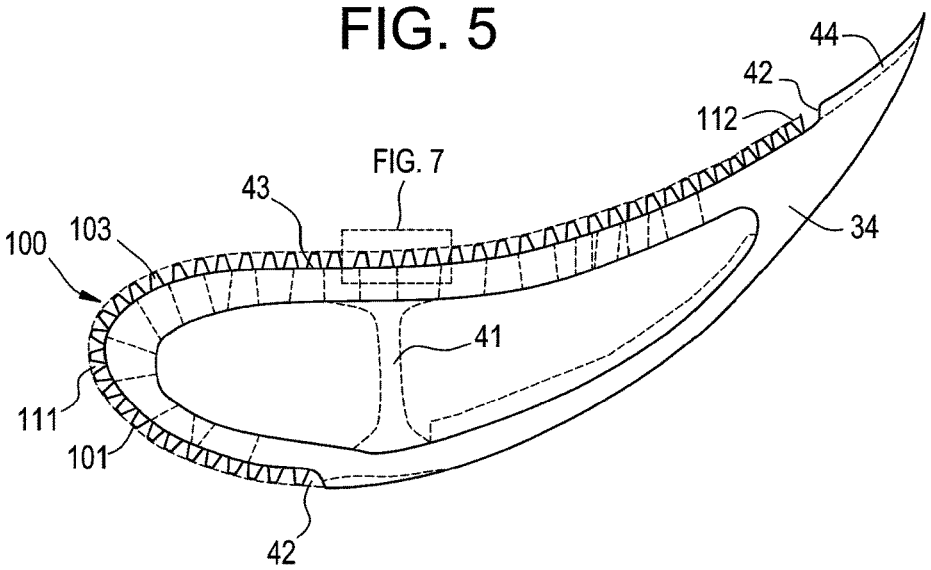
FIG. 5 illustrates a top cross-sectional view of an airfoil having an exemplary heat shield.
Figure 6:
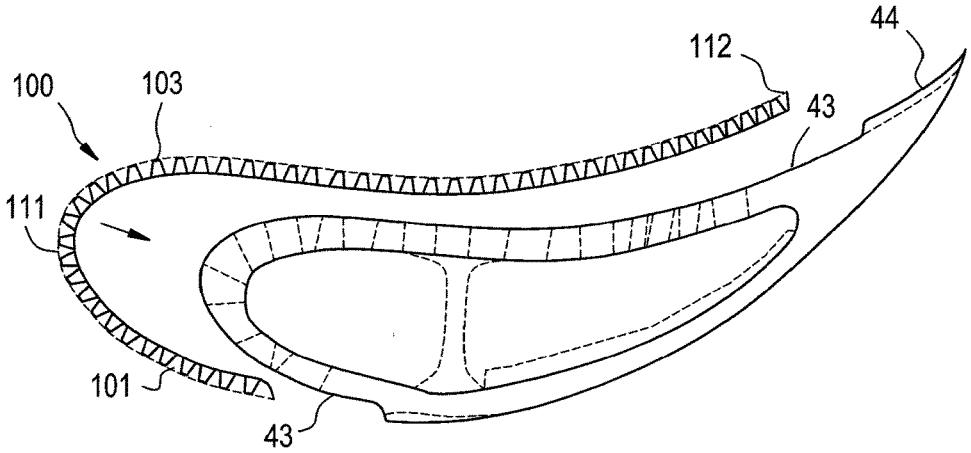
FIG. 6 illustrates a top cross-sectional view of an airfoil having an exemplary heat shield in proximity of the airfoil.

FIG. 5 illustrates a top cross-sectional view of an airfoil 34 having an exemplary heat shield 100. FIG. 6 illustrates a top cross-sectional view of an airfoil 34 having an exemplary heat shield 100 in proximity of the airfoil 34. FIGS. 5 and 6 illustrate that the heat shield 100 has a contour that matches the contour of the airfoil 34. As illustrated, the airfoil 34 can include conventional impingement holes 41 along the airfoil 34. As discussed herein, the impingement holes 41 can be implemented for conventional impingement cooling of the heat shield 100. The airfoil 34 can further include gaps 42 formed between the airfoil 34 and the heat shield 100. The gaps 42 can receive cooling air for flow to the impingement holes 41 for film cooling. As further described herein, the heat shield 100 includes a corrugated layer 101 through which the cooling air can flow. The airfoil 34 can further include a recessed surface 43. The recessed surface 43 enables the affixation of the heat shield 100 onto the airfoil 34. The airfoil 34 can further include trailing edge cooling passages 44 that receive the cooling air. As further described herein, a portion of the corrugated surface 101 of the heat shield 100 provides flow passages for the trailing edge cooling passages 44.

In exemplary embodiments, the heat shield 100 includes multiple layers. As discussed above, the heat shield 100 includes a corrugated layer 101 creates a series of air flow passages along the airfoil 34 providing several flows of cooling air for the impingement holes 41 and the cooling passages 44, the cooling air received in the gaps 42. The heat shield 100 can also include an outer (thermal) layer 103. The outer (thermal) layer 103 is a material with thermal resistance to the hot gas flow (e.g., a thermally insulating ceramic coating or thermal barrier coating (TBC), which can be sprayed on or affixed with a bond layer as described further herein. The corrugated layer 101 maintains an offset between the nozzle and the heat shield 100 as well as adds rigidity to the heat shield 100 as well as the series of cooling air passages as described herein.

Figure 7:
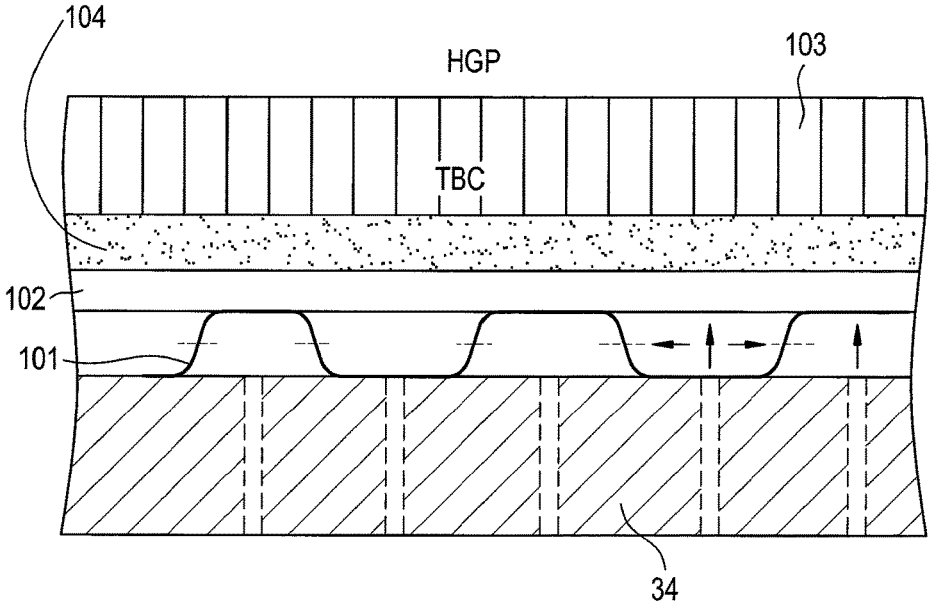
FIG. 7 illustrates a cross-sectional view of an exemplary heat shield.

FIG. 7 illustrates a cross-sectional view of an exemplary heat shield 100. FIG. 7 illustrates the airfoil 34 in mechanical contact with the corrugated layer 101, which can include a base layer 102 rigidly coupled to the corrugated layer 101. In exemplary embodiments, the corrugated layer 101 and the base layer 102 can be a single integral piece. In exemplary embodiments, the base layer 102 can be a high temperature super-alloy that provides structural strength to the heat shield 100, and provides both an aero profile and a smooth-non corrugated surface for outer (thermal) layer 103 to be applied. FIG. 7 further illustrates the outer layer (e.g., the sprayed on TBC) 103, which can include a bonding layer 104 disposed between the base layer 102 and the outer (thermal) layer 103.

Figure 8:
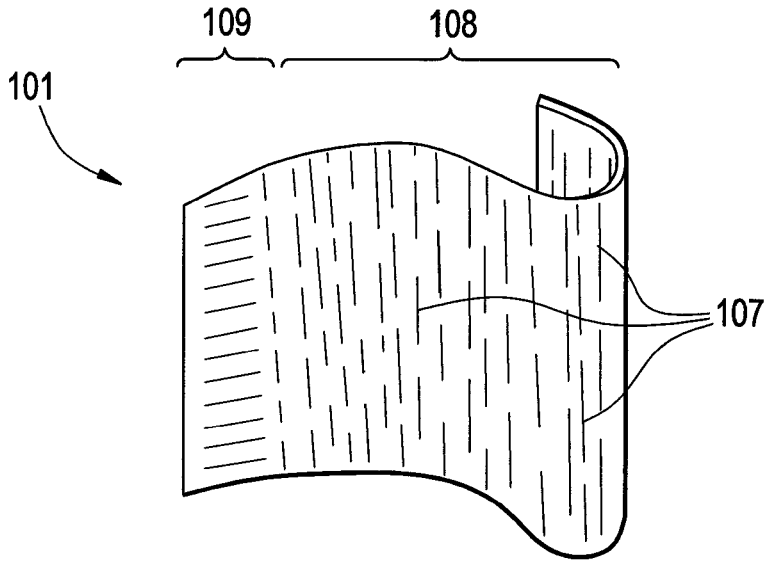
FIG. 8 illustrates the corrugated layer of the heat shield and shown in isolation.

FIG. 8 illustrates the corrugated layer 101 of the heat shield 100, and shown in isolation in order to illustrate the corrugation lines. The outer layer 101 and thermal (outer) layer 103 are not shown for illustrative purposes. In exemplary embodiments, the corrugated layer 101 includes sections of corrugation. The sections of corrugation can have a wide variety of patterns. For example, if there are identified areas of high structural stress on the heat shield 100, patterns of corrugation lines 107 can be denser or spaced closely, while in identified areas of lower stress the density of corrugation lines 107 can be lower, or spaced further apart. In addition, lower density and increased spacing of corrugation lines 107 provides enhanced cooling in the heat shield 100 and thus the airfoil 34. In exemplary embodiments, the impingement holes 41 are arranged orthogonal to the corrugation lines. A first series 108 and a second series 109 of corrugation lines are illustrated. As described above, the first series 108 of corrugated lines receive airflow for the impingement holes 41 and the second series 109 of corrugation lines receive airflow for the trailing edge cooling passages 44. In the example illustrated the first series 108 is arranged orthogonally to the second series 109. In other exemplary embodiments, a variety of other configurations of corrugation lines and series of corrugation lines are contemplated.

Figure 9:
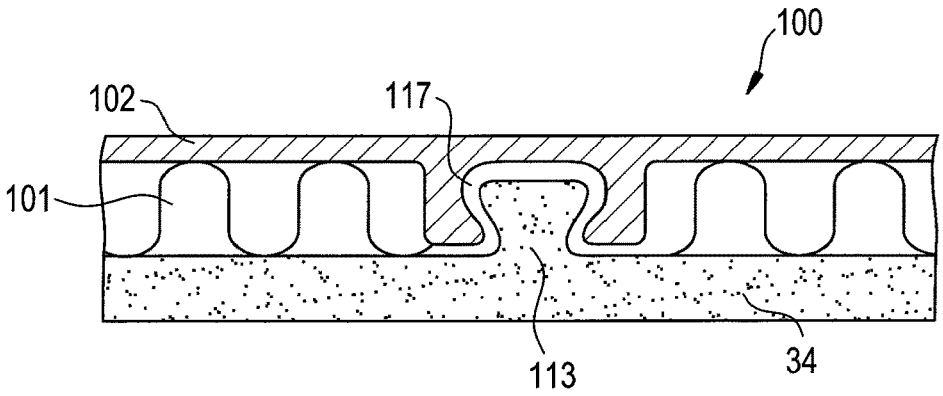
FIG. 9 illustrates an exemplary embodiment of the heat shield having a dovetail attachment arrangement.

FIG. 9 illustrates an exemplary embodiment of the heat shield 100 having a dovetail attachment arrangement. For illustrative purposes, only the corrugated layer 101 and the base layer 102 of the heat shield 100 are illustrated. As described herein, although any type of positive detainment devices can be implemented, dovetails 113 can cover the inner side wall and/or outer side wall of the airfoil 34. The airfoil 34 dovetails 113 can match up with mating heat shield dovetails 117 on the heat shield 100. In exemplary embodiments, the heat shield dovetails 117 can be disposed on the base layer 102 adjacent corrugations on the corrugated layer 101. In other exemplary embodiments, the heat shield dovetails 117 can be disposed on the corrugated layer 101.

Technical effects include the rapid in-field repair of the airfoils implementing the heat shields described herein. Such in-field repair can occur at combustion intervals. One example in which the exemplar heat shield can be implemented is on stage one of a gas turbine, often referred to as S1N. The first stages of gas turbines converge and accelerate the flow after the combustor and hot gas flow, and as a result the flows are tapered; wider at the inlet than at the exit. As illustrated above, the heat shield can cover the S1N on the leading edge as well as a majority of the pressure side of the airfoil and reaches to a high camber point on the suction side of the airfoil. The heat shields described herein in conjunction with the S1N allows the S1N system to be a modular/replicable system rather than a single part design as in conventional systems. Maintenance costs are thus reduced and the service life of the nozzle could increase; when the heat shield begins to wear, the heat shield can be removed and replaced.

In addition, the multi-layer configuration of the heat shield breaks a link between the high temperature section of the nozzle and the structural/load-bearing portion of the nozzle. As described above, the outer wall of the nozzle includes a high heat resistance material, which is then affixed to the corrugated layer that provides airflow and structure to the heat shield. By breaking the link between the high temperature section of the nozzle and the structural/load-bearing portion of the nozzle, the sizeable stress due to thermal gradients is reduced. The multi-layer design of the heat shield traps the cooling air flow between the base layer and the airfoil, and the heat-transfer high temperature layer. This method of cooling is much more efficient than film cooling because the coolant air is trapped between the two layers, rather than being mixed with the hot gas path air reducing the cooling efficiency as film cooling air does as it travels downstream from the hole exit. The reduction in cooling air for the S1N can be used to reduce the combustion temperature for the same output power, thereby reducing $NO_x$ creation, and increasing gas turbine efficiency. The multi-layer design of the heat shield also allows for strain free-operation in the airfoil and significantly lowers bulk metal temperatures on the nozzle structural components by allowing for moderate growth from the heat transfer shield to the base metal and by trapping the coolant air between the heat shield and base metal. As such, less cooling air is needed for the nozzle, thereby helping the efficiency of the engine and reducing $NO_x$ production While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heat shield apparatus for an airfoil, the apparatus comprising:

casing walls configured to be positioned and removable from a turbomachine casing;

a wall disposed between and integrally formed with the casing walls, the wall including:

a base layer adjacent the airfoil; and a thermal layer adjacent the airfoil, wherein the thermal layer matches a contour of the airfoil; the heat shield being distinct from and configured to be removably mounted to the airfoil.

2. The apparatus as claimed in claim 1 wherein the base layer is disposed between the airfoil and the thermal layer.

3. The apparatus as claimed in claim 1 further comprising a corrugated layer coupled to the base layer and in mechanical contact with the airfoil.

4. The apparatus as claimed in claim 3 wherein the corrugated layer includes one or more series of corrugated lines forming air passages.

5. The apparatus as claimed in claim 3 wherein the corrugated layer includes a first density and a first spacing of corrugated lines for structural integrity.

6. The apparatus as claimed in claim 5 wherein the corrugated layer includes a second density and a second spacing of corrugation lines for air flow.

7. The apparatus as claimed in claim 1 wherein the thermal layer includes a pressure side.

8. The apparatus as claimed in claim 7 wherein the thermal layer includes a suction side.

9. An airfoil system, comprising:

an airfoil having a leading edge, impingement holes, a trailing edge passage, a pressure side and a suction side; and a heat shield disposed over the airfoil, the heat shield including:

casing walls configured to be positioned and removable from a turbomachine casing;

a wall disposed between and integrally formed with the casing walls, the wall including:

a base layer adjacent the airfoil;

a thermal layer adjacent the airfoil, wherein the thermal layer matches a contour of the airfoil, the heat shield being distinct from and configured to be removably mounted to the airfoil.

10. The system as claimed in claim 9 wherein the airfoil includes a recessed surface.

11. The system as claimed in claim 10 wherein the heat shield is disposed in the recessed surface.

12. The system as claimed in claim 11 wherein the disposition of the heat shield in the recessed surface forms a gap on the pressure side through which cooling air can flow to the trailing edge passage.

13. The system as claimed in claim 11 wherein the disposition of the heat shield in the recessed surface forms a gap on the suction side through which cooling air can flow to the impingement holes.

14. The system as claimed in claim 9 wherein the heat shield covers the leading edge of the airfoil, a portion of the pressure side of the airfoil and a portion of the suction side of the airfoil.

15. The system as claimed in claim 9 wherein the base layer includes a corrugated layer in mechanical contact with the airfoil, the corrugated layer having one or more series of corrugated lines forming air passages.

16. The system as claimed in claim 15 wherein the corrugated layer includes a first density and a first spacing of corrugated lines for structural integrity.

17. The system as claimed in claim 16 wherein the corrugated layer includes a second density and a second spacing of corrugated lines for air flow.

* * * * *